US009540825B2

(12) United States Patent
Ramachandra

(10) Patent No.: US 9,540,825 B2
(45) Date of Patent: Jan. 10, 2017

(54) FLOATING FLOOR SYSTEM, FLOOR PANEL, AND INSTALLATION METHOD FOR THE SAME

(71) Applicant: ARMSTRONG WORLD INDUSTRIES, INC., Lancaster, PA (US)

(72) Inventor: Sunil Ramachandra, Lancaster, PA (US)

(73) Assignee: AFI Licensing LLC, Lancaster, PA (US)

( * ) Notice: Subject to any disclaimer, the term of this patent is extended or adjusted under 35 U.S.C. 154(b) by 81 days.

(21) Appl. No.: 14/380,432

(22) PCT Filed: Feb. 25, 2013

(86) PCT No.: PCT/US2013/027675
§ 371 (c)(1),
(2) Date: Aug. 22, 2014

(87) PCT Pub. No.: WO2013/126900
PCT Pub. Date: Aug. 29, 2013

(65) Prior Publication Data

US 2015/0020471 A1 Jan. 22, 2015

Related U.S. Application Data

(60) Provisional application No. 61/602,389, filed on Feb. 23, 2012, provisional application No. 61/613,017, filed on Mar. 20, 2012.

(51) Int. Cl.
*E04F 15/02* (2006.01)
*E04F 15/10* (2006.01)

(52) U.S. Cl.
CPC ..... *E04F 15/02038* (2013.01); *E04F 15/105* (2013.01); *E04F 15/107* (2013.01);
(Continued)

(58) Field of Classification Search
None
See application file for complete search history.

(56) References Cited

U.S. PATENT DOCUMENTS 6,682,254 B1 * 1/2004 Olofsson ..... E04B 1/6125 403/345
6,862,857 B2 * 3/2005 Tychsen ..... E04F 15/02 52/582.1

(Continued)

FOREIGN PATENT DOCUMENTS

CN 1754031 A 3/2006
CN 1910327 A 2/2007
WO 2013/155534 A1 * 10/2013

OTHER PUBLICATIONS

Darko Pervan, "VA073a Zip Loc," IP.Com Journal, Sep. 13, 2011, XP013144910, ISSN: 1533-0001, p. 10, line 26-37, figures 2a,2b,2c. IP.Com Inc., West Henrietta, NY (US).

(Continued)

*Primary Examiner* — Robert Canfield

(57) ABSTRACT

A floating floor system and a floor panel and method for use with the same that includes an improved mechanical interlock system. The mechanical interlock system allows laterally adjacent floor panels that are mechanically interlocked to slide relative to one another a predetermined distance in a longitudinal direction, while prohibiting relative translation in the vertical and transverse directions. In one embodiment, the predetermined distance eliminates the need for precision cuts during installation, thereby making installation fast and easy. In a further embodiment, the invention optimizes the floor panels (and floating floor system.) to balance ease of installation and horizontal locking strength between laterally adjacent floor panels.

17 Claims, 17 Drawing Sheets

(52) U.S. Cl.
CPC ..... *E04F 2201/0123* (2013.01); *E04F 2201/0138* (2013.01); *E04F 2201/02* (2013.01); *E04F 2201/021* (2013.01); *E04F 2201/03* (2013.01); *E04F 2203/065* (2013.01)

(56) References Cited

U.S. PATENT DOCUMENTS

| | | | | |
|---|---|---|---|---|
| 8,505,257 | B2 * | 8/2013 | Boo | B27F 1/02 52/582.1 |
| 8,544,121 | B1 * | 10/2013 | Majocka | E03D 11/14 4/252.2 |
| 8,584,432 | B2 * | 11/2013 | Braun | E04F 15/02 428/50 |
| 2003/0009971 | A1 * | 1/2003 | Palmberg | E04F 15/02 52/578 |
| 2003/0101681 | A1 * | 6/2003 | Tychsen | E04F 15/02 52/783.1 |
| 2009/0193748 | A1 * | 8/2009 | Boo | B27F 1/02 52/589.1 |
| 2010/0218450 | A1 * | 9/2010 | Braun | E04F 15/02 52/588.1 |
| 2013/0047536 | A1 * | 2/2013 | Pervan | B26D 1/14 52/309.1 |
| 2014/0090335 | A1 * | 4/2014 | Pervan | B27F 1/08 52/745.05 |
| 2015/0113908 | A1 * | 4/2015 | Ramachandra | E04F 15/02038 52/745.13 |
| 2015/0152644 | A1 * | 6/2015 | Boo | E04F 15/02038 52/588.1 |

OTHER PUBLICATIONS

Ola Engstrand, "va043 5G Linear Slide Tounge," IP.Com Journal, Feb. 4, 2009, XP013129255, ISSN: 1533-0001, entire document, IP.Com Inc., West Henrietta, NY (US).

International Search Report issued in International Application PCT/US13/27675 mailed Oct. 1, 2013.

CN search report for corresponding Application No. 2013800107638, mailed Oct. 21, 2015.

* cited by examiner

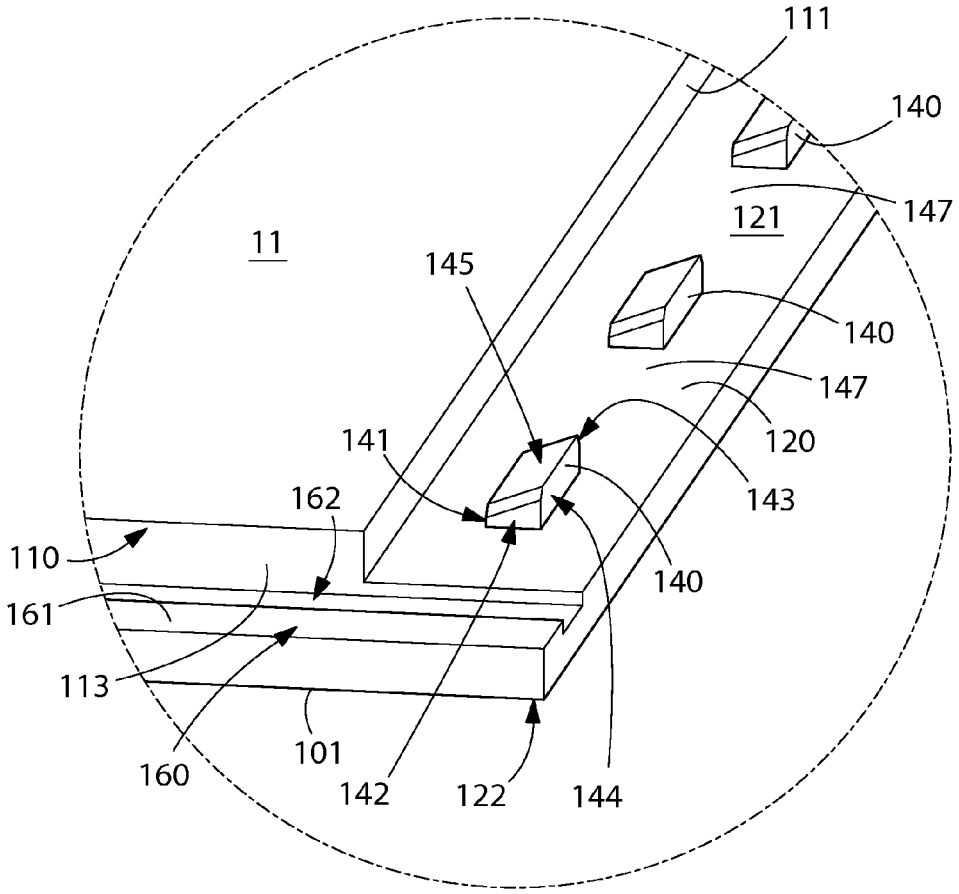
FIG. 1-A

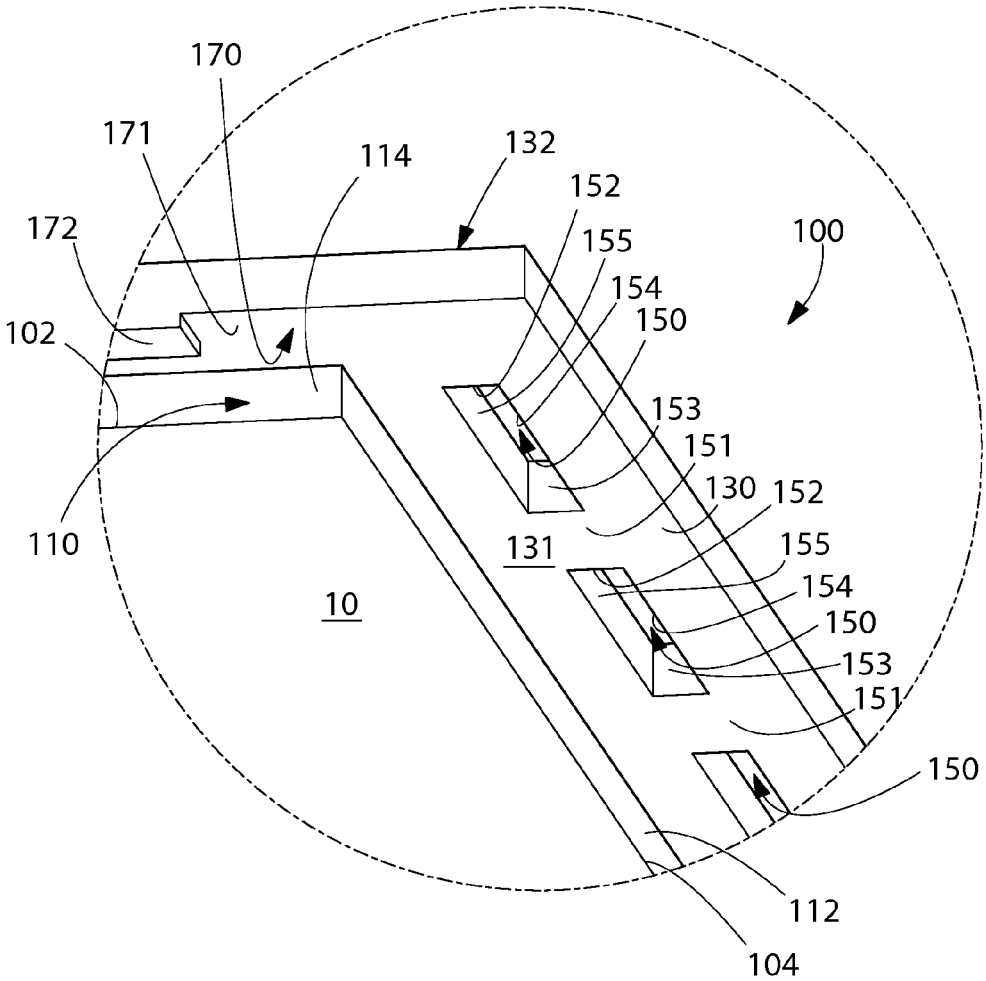
FIG. 2-A

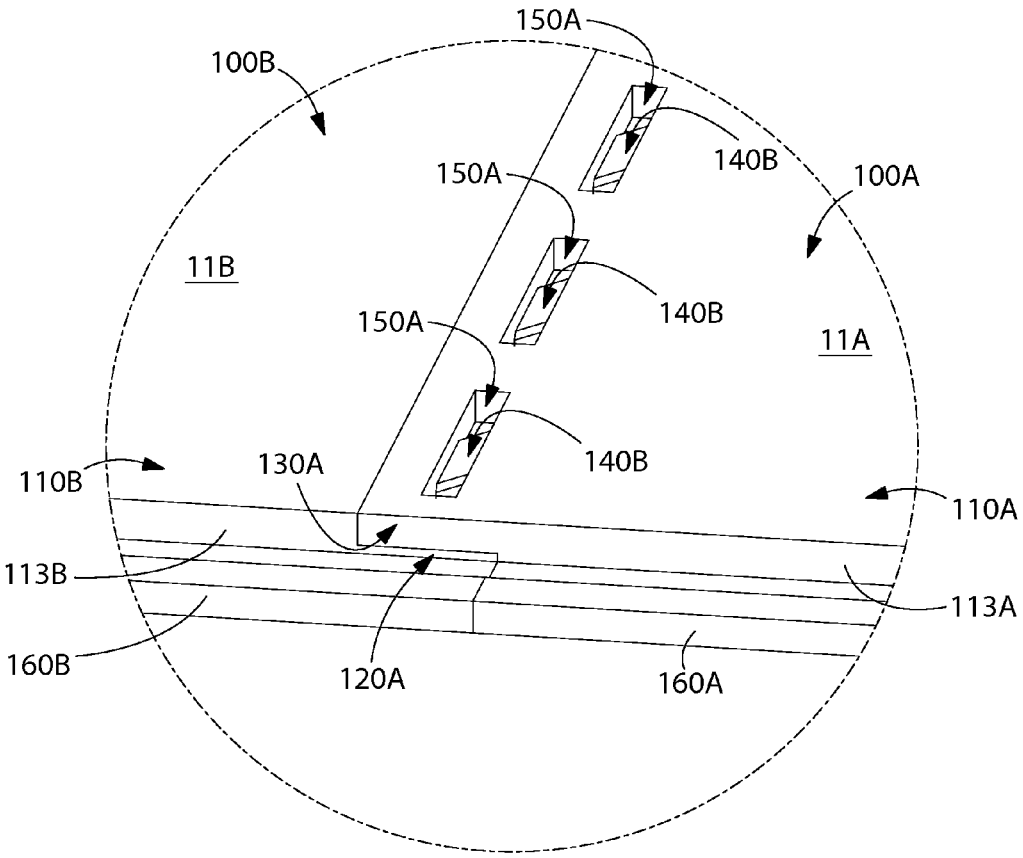
FIG. 4-A

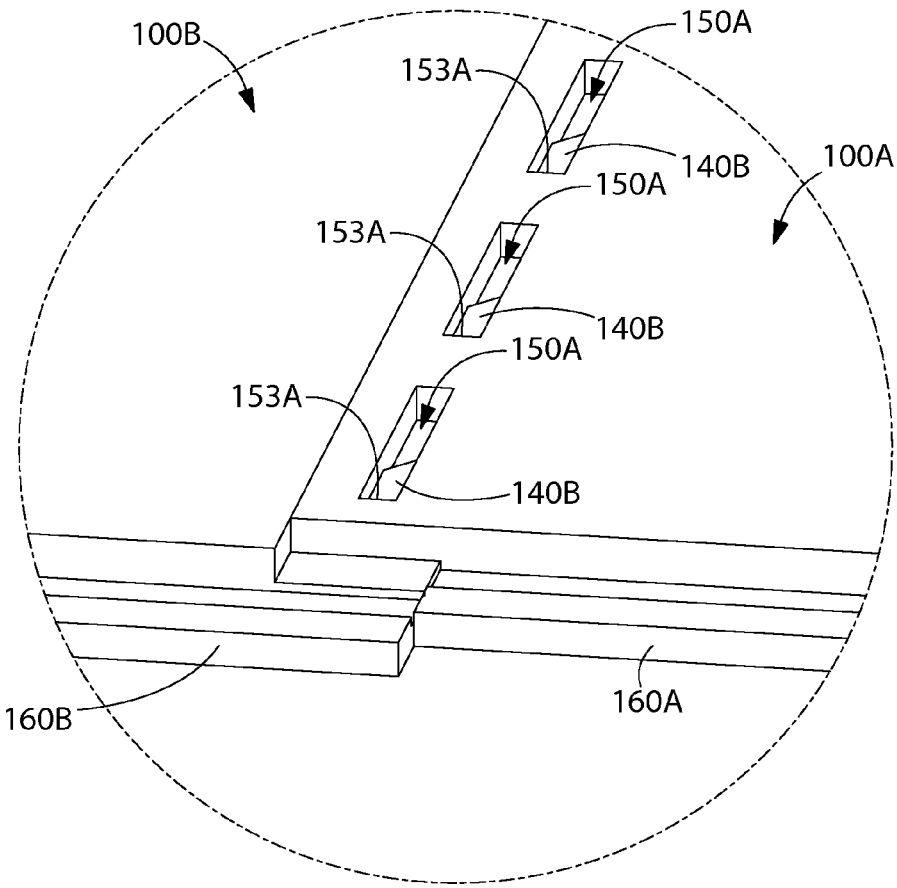
FIG. 7-A

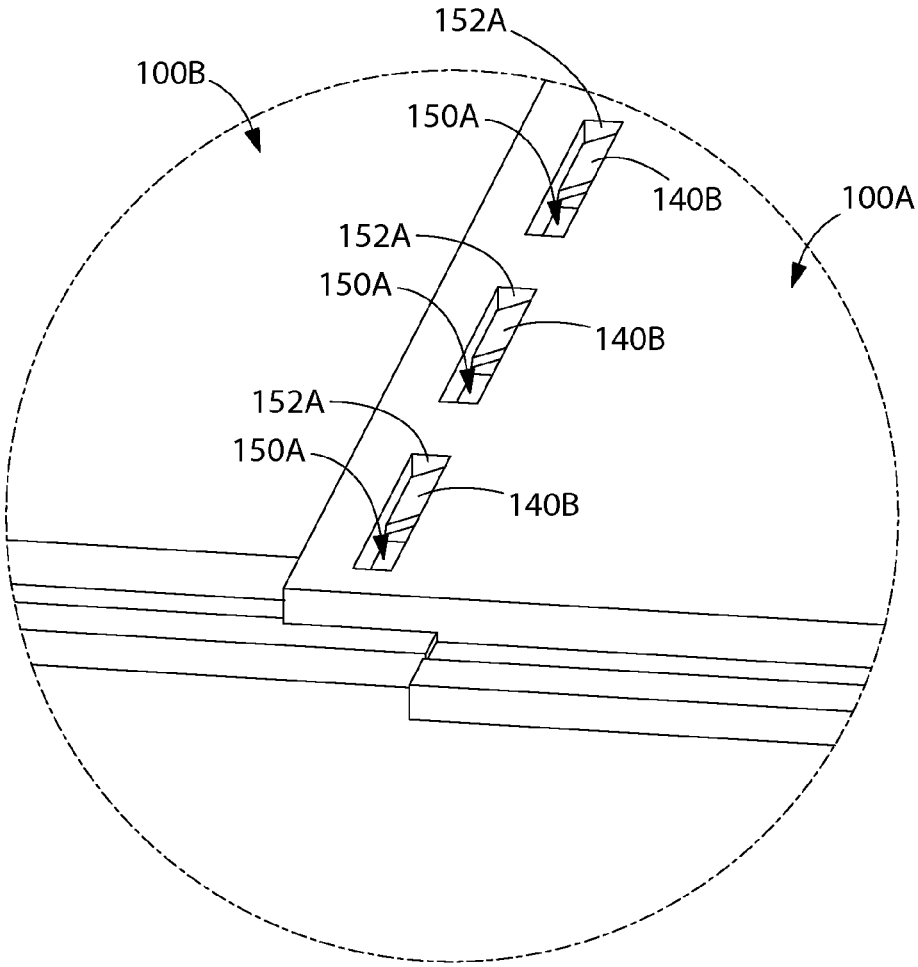
FIG. 7-B

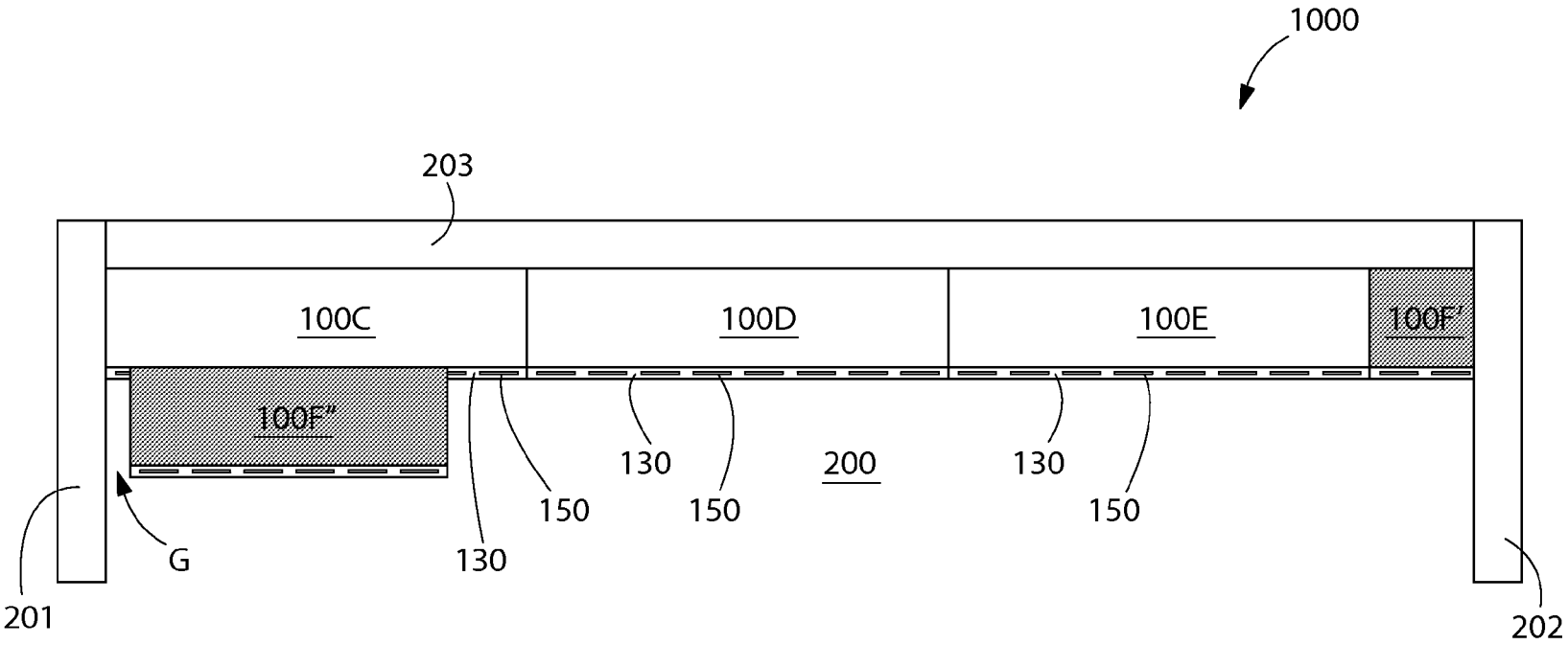
FIG. 9-A

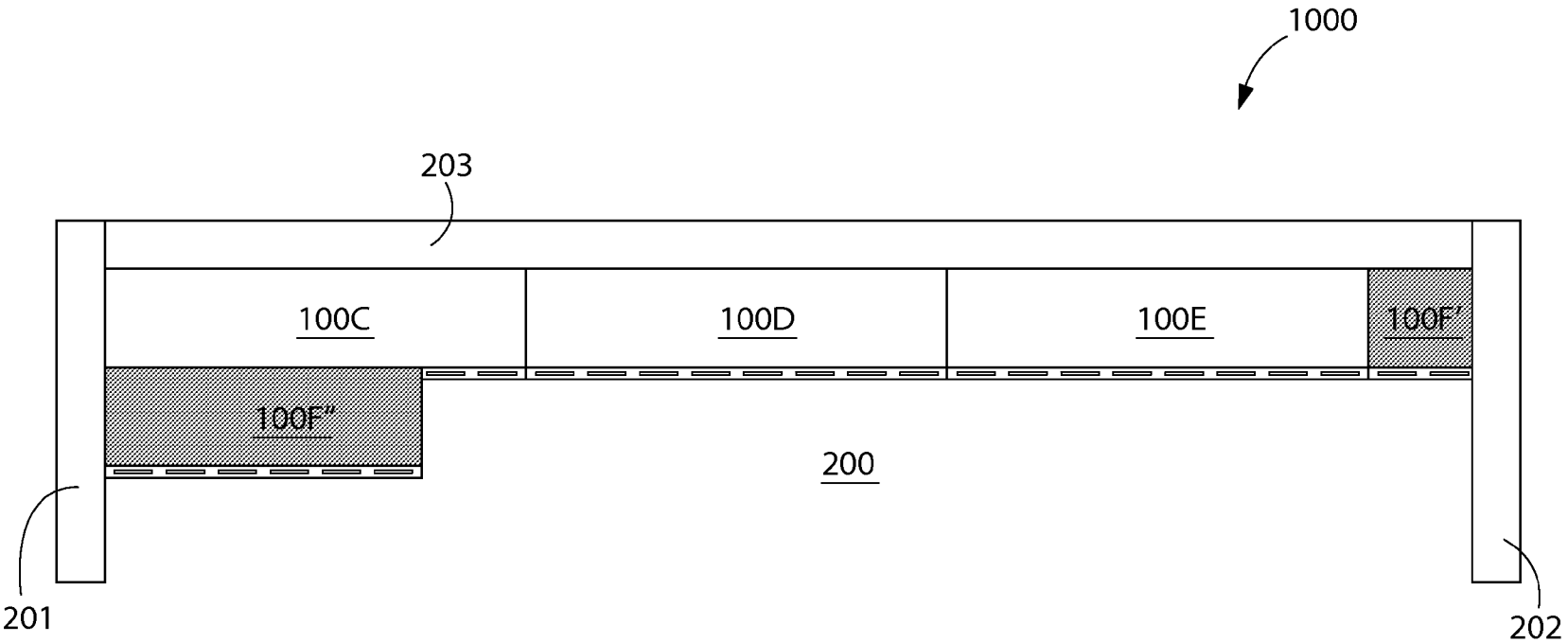
FIG. 9-B

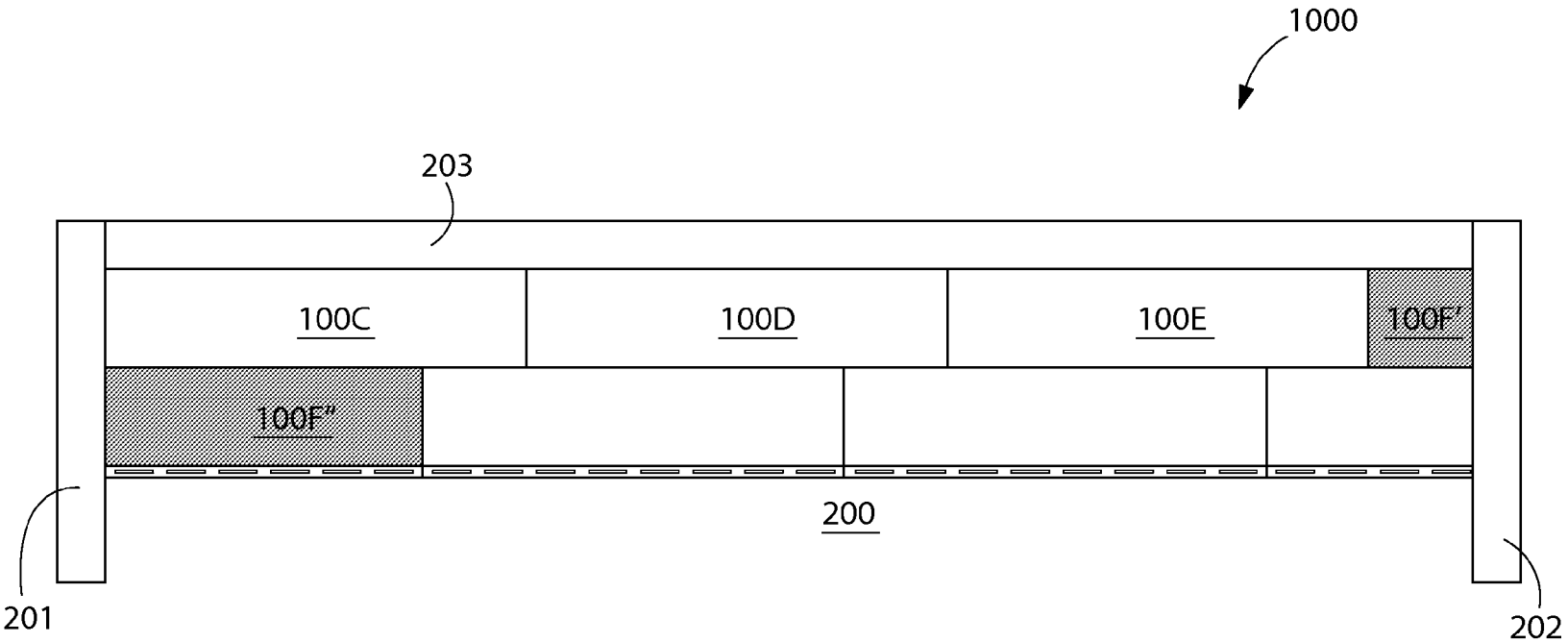
FIG. 9-C

FLOATING FLOOR SYSTEM, FLOOR PANEL, AND INSTALLATION METHOD FOR THE SAME

CROSS-REFERENCE TO RELATED PATENT APPLICATIONS

The present application is a U.S. National Stage Application under 35 U.S.C. §371 of PCT Application No. PCT/US2013/027675, filed Feb. 25, 2013, which in turn claims the benefit of U.S. Provisional Patent Application Ser. No. 61/613,017, filed Mar. 20, 2012, and U.S. Provisional Patent Application Ser. No. 61/602,389, filed Feb. 23, 2012, the entireties of which are herein incorporated by reference.

FIELD OF THE INVENTION

The present invention relates generally to floor systems, floor panels, and installation methods thereof, and particularly to an enhanced mechanical interlock system for said floor systems, floor panels, and installation methods thereof. The present invention is particularly suited for floating floor systems.

BACKGROUND OF THE INVENTION

Floating floor systems are known in the art. In existing floating floor systems, the floor panels are typically interlocked together via chemical adhesion. For example, the floor panels of existing floating floor systems generally comprise a lower lateral flange and an upper lateral flange extending from opposite sides of the floor panel body. At least one of the upper and/or lower lateral flanges has an exposed adhesive applied thereto. In assembling/installing such a floating floor system, the lower flanges of the floor panels are overlaid by the upper flanges of adjacent ones of the floor panels. As a result, the exposed adhesive interlocks the upper and lower flanges of the adjacent floor panels together. The assembly/installation process is continued until the entire desired area of the sub-floor is covered.

Recently, attempts have been undertaken to develop floating floor systems in which the floor panels mechanically interlock. One known mechanical interlocking floating floor system utilizes teeth and slots on the upper and lower flanges respectively that mate with one another to create the desired interlock between the floor panels. One problem, with these existing mechanical interlocking systems is that the teeth are not easily alignable with the slots, thereby making the installation/assembly process difficult. Additionally, in these existing floating floor systems, the teeth do not engage the slots even when aligned properly because of the straight 90 degree sides and clearance issues.

Thus, a need exists for an improved floating floor system, floor panel, and method of installing the same that utilizes a mechanical interlocking system.

BRIEF SUMMARY OF THE INVENTION

The present invention is directed to a floating floor system that utilizes a mechanical interlock system that allows longitudinally adjacent floor panels that are interlocked together to slide a sufficient distance relative to one another, while at the same time remaining interlocked in the transverse direction. In certain embodiments, this sliding may minimize and/or eliminate the need for precision cutting of the floor panels during the installation process, thereby simplifying the installation process. In certain embodiments, the mechanical interlock system may be configured such that the aforementioned sliding is facilitated while at the same time achieving a desired horizontal locking strength (HLS) per unit length of the floor panel that is greater than or equal to a predetermined lower threshold value. Thus, in one embodiment, the present invention is an optimized floor panel that balances ease of installation with sufficient HLS.

In one embodiment, the invention can be a floating floor system comprising: a plurality of panels, each of the panels having a panel length $L_P$ measured along a longitudinal axis and comprising: a body; a first flange extending from a first lateral edge of the body; a second flange extending from a second lateral edge of the body; X number of spaced apart teeth protruding from a first surface of the first flange, each of the teeth extending a tooth length $L_T$; a plurality of spaced apart slots formed in a first surface of the second flange, each of the slots extending a slot length $L_S$; and wherein $L_S-L_T$ is greater than or equal to 6 mm; and wherein X and $L_T$ are such that when first and second ones of the plurality of panels are interlocked so that the teeth of the first panel are located in the slots of the second panel, the teeth exert a horizontal resistance force $F_{HR}$ per unit length of the teeth in response to a horizontal separation force $F_{HR}$ applied to the first and second panels before the first and second panels separate, the horizontal resistance force $F_{HR}$ corresponding to a horizontal locking strength HLS per unit length of $L_P$ that is greater than or equal to a predetermined lower threshold value.

In another embodiment, the invention can be a floor panel for a floating floor system comprising: a body having a longitudinal axis; a first flange extending from a first lateral edge of the body; a second flange extending from a second lateral edge of the body; a plurality of spaced apart teeth protruding from a first surface of the first flange, each of the teeth extending a tooth length $L_T$; a plurality of spaced apart slots formed in a first surface of the second flange, each of the slots extending a slot length $L_S$, wherein $L_S-L_T$ is greater than or equal to 6 mm; and wherein the teeth and slots are arranged so when first and second ones of the floor panels are positioned laterally adjacent to one another, the teeth of the first floor panel mate with the slots of the second panel to interlock the first and second floor panels.

In a further embodiment, the invention can be a floor panel for a floating floor system comprising: a body having a longitudinal axis; a first flange extending from a first lateral edge of the body; a second flange extending from a second lateral edge of the body; a plurality of spaced apart teeth protruding from a first surface of the first flange, each of the teeth extending a tooth length $L_T$; a plurality of spaced apart slots formed in a first surface of the second flange, each of the slots extending a slot length $L_S$, wherein: $L_S-L_T \geq 0.5\ L_T$; and wherein the teeth and slots are arranged so when first and second ones of the floor panels are positioned laterally adjacent to one another, the teeth of the first floor panel mate with the slots of the second panel to interlock the first and second floor panels.

In a still further embodiment, the invention can be a method of installing a plurality of floor panels to create a floating floor system, each of the floor panels comprising a body having a longitudinal axis, an upper flange extending from a first lateral edge of the body, a lower flange extending from a second lateral edge of the body, a plurality of spaced apart teeth protruding from a lower surface of the upper flange, each of the teeth extending a tooth length $L_T$, a plurality of spaced apart slots formed in an upper surface of the lower flange, each of the slots extending a slot length $L_S$, the method comprising: a) coupling a plurality of first row floor panels together in an end-to-end axial alignment to form a first row of floor panels, wherein a first row starter floor panel is in abutment with a vertical obstruction; b) interlocking a second row starter floor panel to one or more of the first row floor panels by overlapping the lower flanges of the one or more first row floor panels with the upper flange of the second row starter floor panel so that the teeth of the second row starter floor panel are located within the slots of one or more first row floor panels, wherein the one or more first row floor panels comprises the first row starter floor panel and a gap exists between a proximal edge of the second row starter floor panel and the vertical obstruction; and c) sliding the second row starter floor panel toward the vertical obstruction to eliminate the gap while the second row starter floor panel remains interlocked to the one or more first row floor panels.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 1A is a close-up view of area I-A of FIG. 1;

FIG. 2A is a close-up view of area II-A of FIG. 2;

FIG. 4A is close-up view of area IV-A of FIG. 4;

FIG. 7A is a bottom perspective view of the mechanically interlocked floor panels of FIG. 4 in a first state;

FIG. 7B is a bottom perspective view of the mechanically interlocked floor panels of FIG. 4, wherein the second floor panel has been slid relative to the first floor panel to a second state;

FIGS. 9A-9C schematically illustrate a floating floor system being installed in accordance with a method of the present invention:

DETAILED DESCRIPTION OF THE INVENTION

The following description of the preferred embodiment(s) is merely exemplary in nature and is in no way intended to limit the invention, its application, or uses. The description of illustrative embodiments according to principles of the present invention is intended to be read in connection with the accompanying drawings, which are to be considered part of the entire written description. Moreover, the features and benefits of the invention are illustrated by reference to the exemplified embodiments. Accordingly, the invention expressly should not be limited to such exemplary embodiments, which illustrate some possible non-limiting combinations of features that may exist alone or in other combinations of features; the scope of the invention being defined by the claims appended hereto.

Figure 1:
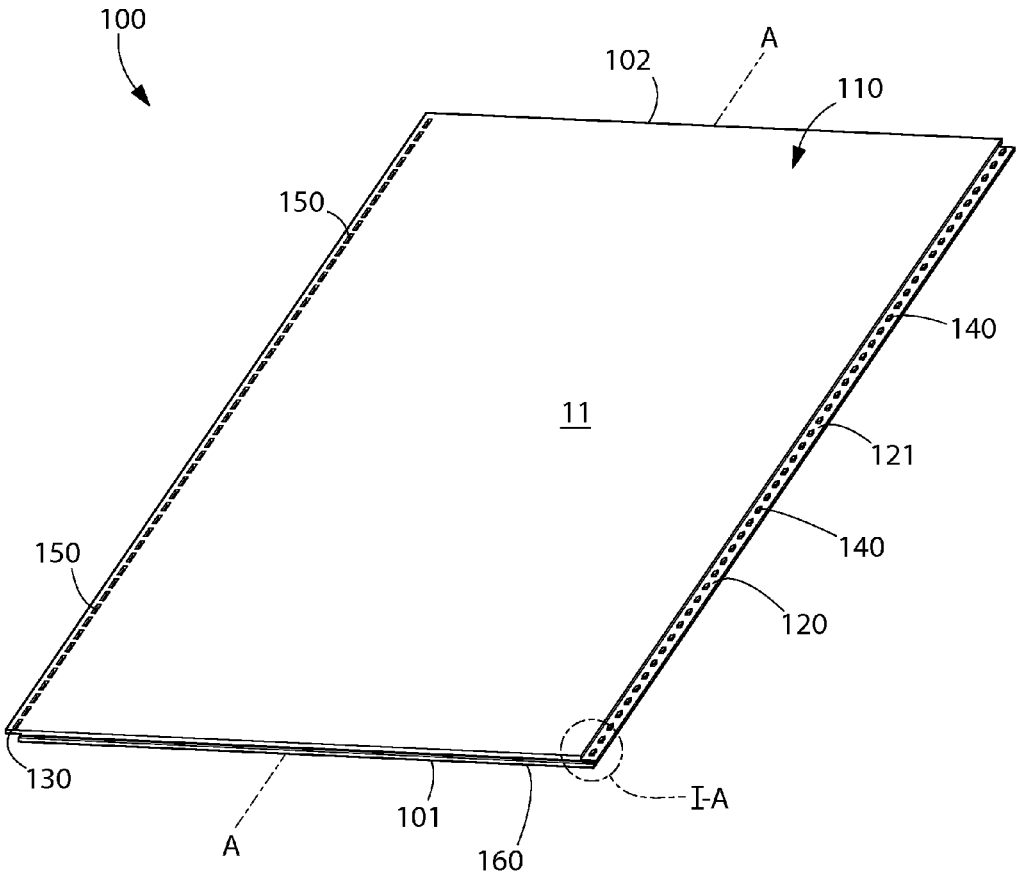
FIG. 1 is a bottom perspective view of a floor panel according to one embodiment of the present invention.
Figure 2:
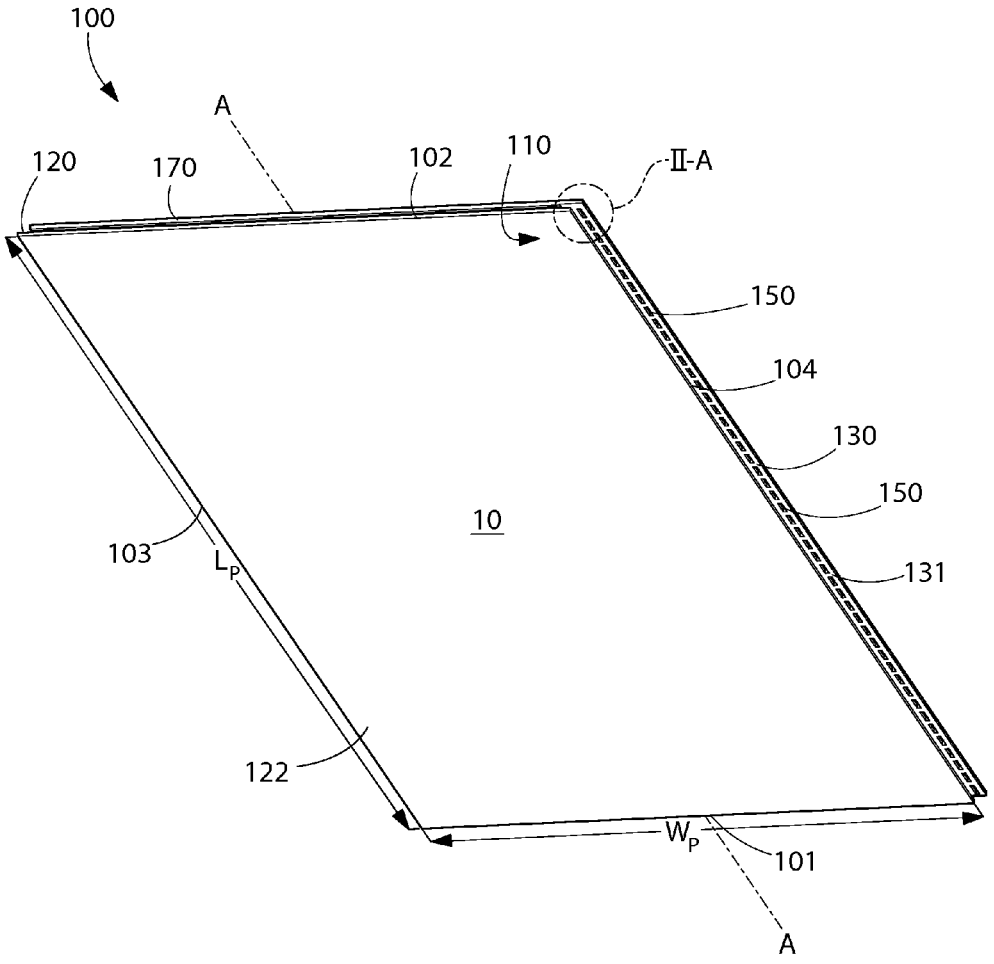
FIG. 2 is a top perspective view of the floor panel of FIG. 1.
Figure 3:
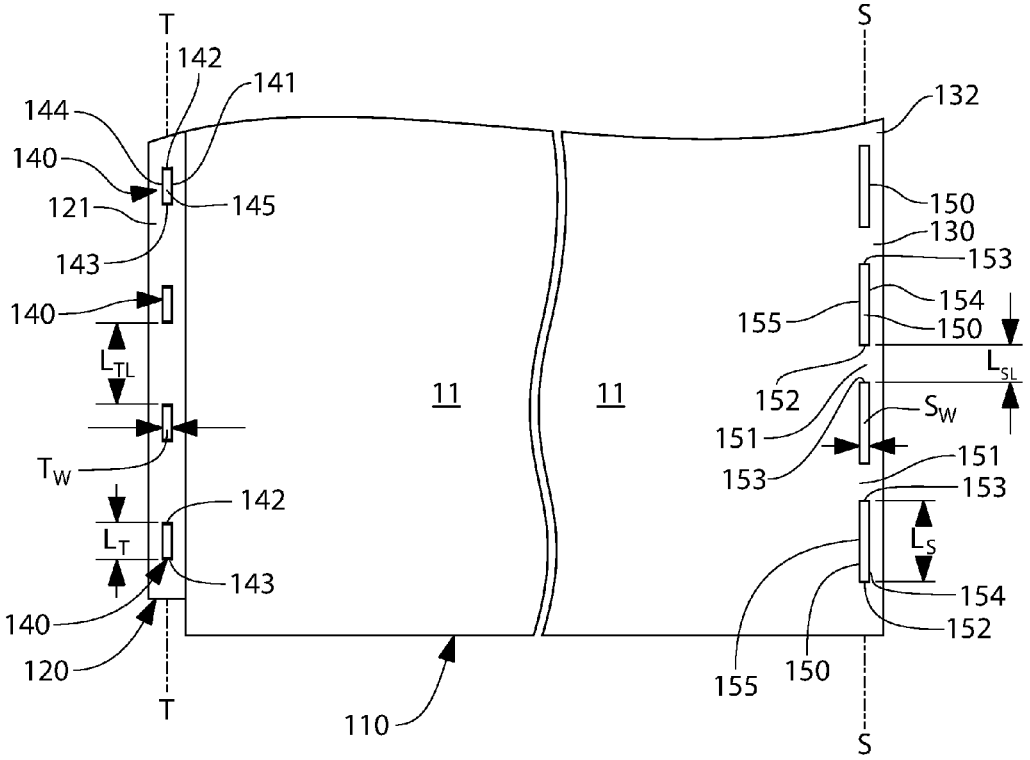
FIG. 3 is a bottom view of a distal end portion of the floor panel of FIG. 1.

Referring first to FIGS. 1-3 concurrently, a floor panel 100 according to an embodiment of the present invention is illustrated. In one embodiment, the floor panel 100 may be a vinyl tile, having a composition and laminate structure (with the exception of the mechanical interlock system as discussed below) as disclosed in United States Patent Application Publication No. 2010/0247834, published Sep. 30, 2010, the entirety of which is hereby incorporated by reference in its entirety. Additionally, while the inventive panel 100 is referred to herein as a "floor panel," it is to be understood that the inventive floor panel 100 can be used to cover other surfaces, such as wall surfaces.

The floor panel 100 generally comprises a top surface 10 and an opposing bottom surface 11. The top surface 10 is intended to be visible when the floor panel 100 is installed and, thus, may be a finished surface comprising a visible decorative pattern. To the contrary, the bottom surface 11 is intended to be in surface contact with the surface that is to be covered, such as a top surface of a sub-floor. The term sub-floor, as used herein, is intended to include any surface that is to be covered by the floor panels 100, including without limitation plywood, existing tile, cement board, concrete, wall surfaces, hardwood planks and combinations thereof. Thus, in certain embodiments, the bottom surface 11 may be an unfinished surface.

The floor panel 100 extends along a longitudinal axis A-A. In the exemplified embodiment, the floor panel 100 has a rectangular shape. In other embodiments of the invention, however, the floor panel 100 may take on other polygonal shapes. The floor panel 100 has a panel length $L_P$ measured along the longitudinal axis A-A from a proximal edge 101 of the top surface 10 to a distal edge 102 of the top surface 10. The floor panel 100A also comprises a panel width $W_P$ measured from a first lateral edge 103 of the top surface 10 to a second lateral edge 104 of the top surface 10 in a direction transverse to the longitudinal axis A-A. In certain such embodiments (such as the exemplified one), the floor panel 100 is an elongated panel such that $L_P$ is greater than $W_P$. In other embodiments, however, the floor panel 100 may be a square panel in which $L_P$ is substantially equal to $W_P$.

The floor panel 100 generally comprises a body 110, a first flange 120 extending from a first lateral edge 111 of the body 110, and a second flange 130 extending from a second lateral edge 112 of the body 110. In the exemplified embodiment, due to the top surface 10 being the intended display surface of the floor panel 100, the first flange 120 may be considered the upper flange while the second flange 130 may be considered the lower flange in certain embodiments. In other embodiments, however, the floor panel 100 may be designed such that the second flange 130 (along with the slots 150) is the upper flange that forms a portion of the top surface 10 of the floor panel 100 while the first flange 120 (along with the teeth 140) is the lower flange that forms a portion of the bottom surface 11.

The first and second lateral edges 111, 112 of the body 110 are located on opposite sides of the body 10 and extend substantially parallel to the longitudinal axis A-A. Thus, the first and second flanges 120, 130 extend from opposite lateral sides of the body 110. In the exemplified embodiment, the first flange 120 is a continuous flange that extends along substantially the entire length of the floor panel 100. Similarly, the second flange 130 is also a continuous flange that extends along substantially the entire length of the floor panel 100. In certain embodiments, however, the first and/or second flanges 120, 130 can be discontinuous so as to comprises a plurality of flange segments that are separated by a gap.

Figure 10:
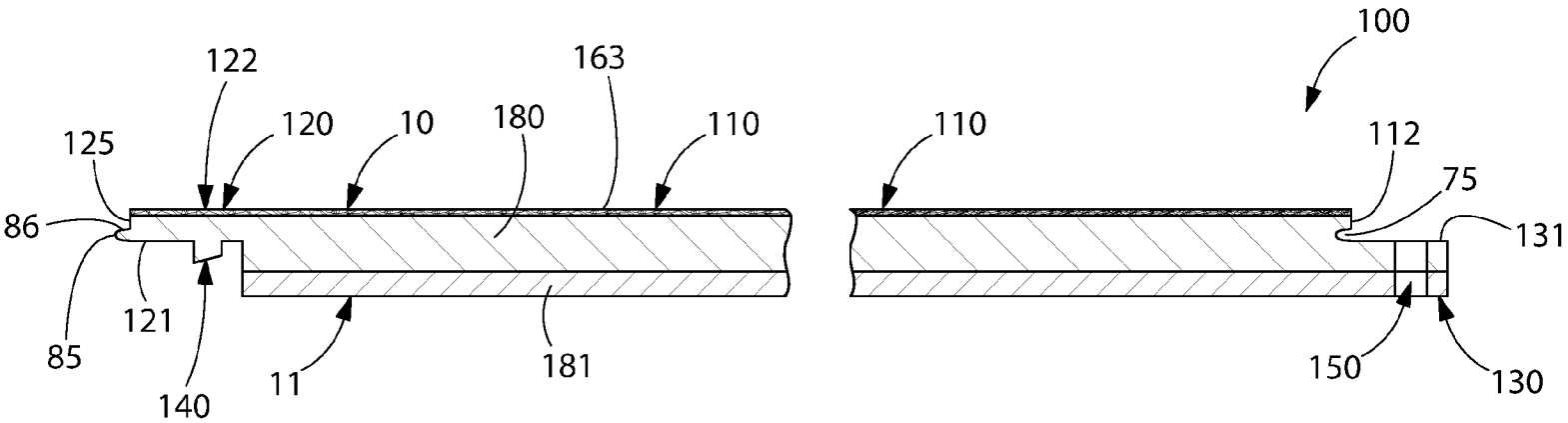
FIG. 10 is a cross-sectional schematic of a floor panel of FIG. 1 showing additional details thereof.

In the exemplified embodiment, a first surface 121 of the first flange 120 is substantially coplanar with a first surface 131 of the second flange 130 (best shown in FIG. 10). In certain other embodiments, however, the first surface 121 of the first flange 120 and the first surface 131 of the second flange 130 may be oblique relative to the top and bottom surfaces 10,11 of the floor panel 10. In such embodiments, the first surface 121 of the first flange 120 will be substantially parallel to the first surface 131 of the second flange 130 but will be non-coplanar therewith.

As can be seen, the first flange 120 comprises a second surface 122 that is opposite to the first surface 121 of the first flange 120. The second surface 122 of the first flange 120 is substantially coplanar with a top surface of the body 110. Thus, the second surface 122 of the first flange and the top surface of the body 110 collectively form the top surface 10 of the floor panel 100. To the contrary, the second flange 130 comprises a second surface 132 that is opposite to the first surface 131 of the second flange 130. The second surface 132 of the second flange 130 is substantially coplanar with a bottom surface of the body 110. Thus, the second surface 132 of the second flange 130 and the bottom surface of the body 110 collectively form the bottom surface 11 of the floor panel 100. The invention, however, is not so limited in all embodiments.

Referring now to FIGS. 2-A and 3 concurrently, in the exemplified embodiment the slots 150 are through-slots in that they extend through the entire thickness of the second flange 130, thereby forming passageways from the first surface 131 of the second flange 130 to the second surface 132 of the second flange 130. In other embodiments, however, the slots 150 may not extend through the entire thickness of the second flange 120 so long as they are deep enough to accommodate the height of the teeth 140.

Each of the slots 150 has a closed-geometry configuration. The slots 150 are equi-spaced from one another along a slot axis S-S that is substantially parallel to the longitudinal axis A-A. In other embodiments, however, the spacing between the slots 150 may not be equidistant. In still other embodiments, the slots 150 may be arranged in an axially offset or staggered manner so long as the teeth 140 and slots 150 are correspondingly arranged so that the slidable mating discussed below can be accomplished.

In the exemplified embodiment, each of the slots 150 is an elongated slot having a slot length $L_S$ (which is measured from a first slot wall 152 to an opposing second slot wall 153 along the slot axis S-S) that is greater its slot width $S_W$ (which is measured from a third slot wall 154 to an opposing fourth slot wall 155 transverse to the slot axis S-S). For each slot 150, the slot walls 152-155 collectively define the closed-geometry of the slot 150.

Adjacent slots 150 of the floor panel 100 are spaced from another by a slot landing area 151 of the second flange 130. Each slot landing area 151 extends a length $L_{SL}$ (measured from the first slot wall 152 of one of the slots 150 to the second slot wall 153 of the immediately adjacent slot 150 along the slot axis S-S).

The floor panel 100 further comprises a plurality spaced apart teeth 140 protruding from a first surface 121 of the first flange 120. The teeth 140 and the slots 150 are arranged on the floor panel 100 in a pattern corresponding to one another so that when two of the floor panels 100 are properly positioned (see FIG. 4), the floor panels 100 can be interlocked together by inserting the teeth 140 of one of the floor panels 100 into the slots 150 of the other one of the floor panels 100.

Referring now to FIGS. 1A and 3 concurrently, each of the teeth 140 protrude from the first surface 121 of the first flange 120. The teeth 140 are equi-spaced from one another along a tooth axis T-T that is substantially parallel to the longitudinal axis A-A. In other embodiments, however, the spacing between the teeth 140 may not be equidistant. In still other embodiments, the teeth 140 may be arranged in an axially offset or staggered manner so long as the teeth 140 and slots 150 are correspondingly arranged so that the slidable mating discussed below can be accomplished.

Figure 4:
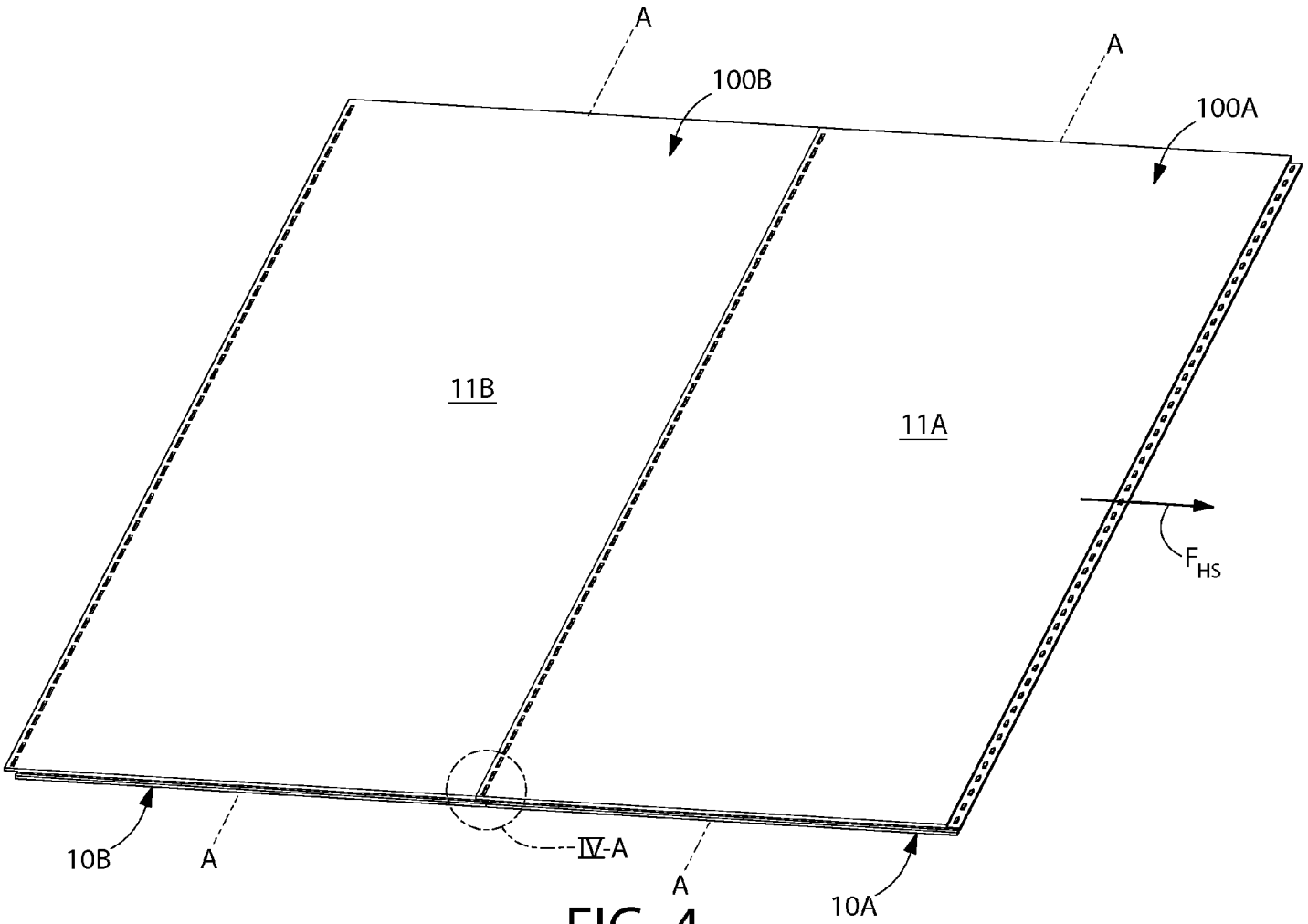
FIG. 4 is a bottom perspective view of first and second ones of the floor panel of FIG. 1 mechanically interlocked to one another in accordance with an embodiment of the present invention.

Each of the teeth 140 comprises a locking wall 141, a first end wall 142, a second end wall 143, an abutment wall 144, and a top surface 145 that collectively define the tooth 140. As will be discussed in more detail below, when two of the floor panels 100 are interlocked together by inserting the teeth 140 of one floor panel 100 into the slots 150 of another floor panel 100 (as shown in FIG. 4), interference between the locking walls 141 of the teeth 140 and the third slot walls 154 of the slots 150 prevent relative movement between the floor panels 100 in the transverse direction when subjected to a horizontal loading force.

In the exemplified embodiment, the top surface 145 of each tooth 140 is angled inward toward the longitudinal axis A-A of the floor panel 100 such that the abutment wall 144 has a height that is greater than the height of the locking wall 141. In other words, the top surface 145 can be considered to have an inward chamfer so as to facilitate ease of inserting the teeth 140 into the slots 150 during interlocking and installation. Moreover, by chamfering the top surfaces 145 of the teeth 140 inward, interlocking of the floor panels 100 together is not only easier but also results in the floor panels 100 being pulled together during the interlocking process so as to minimize and/or eliminate the visible gap between adjacent rows of floor panels 100 in the installed floating floor system 1000 (see FIGS. 9A-9C). The teeth 140 may further comprise additional chamfered edges (rounded edges or fillets) at the intersection between the first end wall 142 and the top surface 145 and at the intersection between the second end wall 143 and the top surface 145. This further facilitates ease of installation. In other embodiments, the edges may be rounded or include fillets to facilitate ease of installation. Of course, the teeth 140 can have alternate geometries that may or may not include chamfers, fillets or rounded edges.

Figure 11:
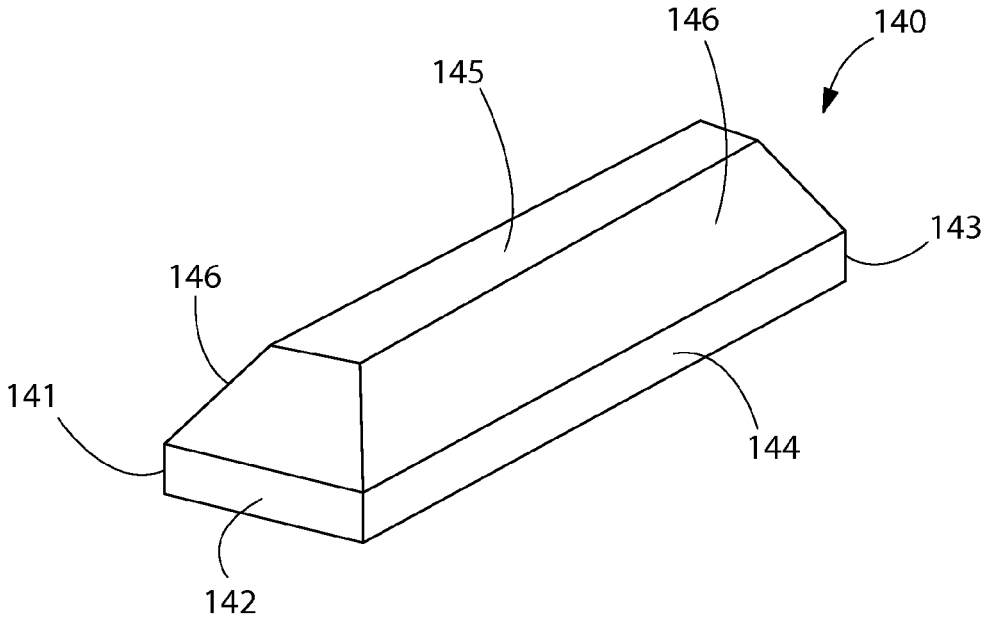
FIG. 11 is a perspective view of an alternate tooth geometry that can be utilized with the floor panel of FIG. 1.

Referring to FIG. 11, an alternate tooth geometry is exemplified. In this embodiment, the teeth 140 are given a geometry in which the locking wall 141 and the abutment wall 144 have the same height. Moreover, the top surface 145 is not inclined relative to first surface 121 of the first flange 120 or to the locking and abutment walls 141, 144. However, in this embodiment, chamfered edges/surfaces 146 are provided at the intersection between the locking wall 141 and the top surface 145 and at the intersection between the abutment wall 144 and the top surface 145. Chamfering the appropriate surfaces and/or edges of the teeth 140 results in easier interlocking of the floor panels 100 and, thus, faster installation.

Referring again to FIGS. 1A and 3 concurrently, each of the teeth 140 have a tooth length $L_T$ (which is measured from the first end wall 142 to the second end wall 143 along the tooth axis T-T) and a tooth width $T_W$ (which is measured from the locking wall 141 to the abutment wall 144 transverse to the tooth axis T-T). In one embodiment, each of the teeth 140 are elongated in that they have a tooth length $L_T$ that is greater than the tooth width $T_W$.

Adjacent teeth 140 are spaced from another by a tooth landing area 147 of the first flange flange 120. Each tooth landing area 147 extends a length $L_{TL}$ (measured from the first end wall 142 of one tooth 140 to the second end wall 143 of the immediately adjacent tooth 140 along the tooth axis T-T).

The teeth 140 are integrally formed with at least a portion of the first flange 120 in certain embodiments (see FIG. 10) to improve strength and to minimize breaking, shearing and/or delamination of the floor panel 100. In other embodiments, however, the teeth 140 can be separately formed and subsequently coupled thereto, such as via a mechanical or chemical bond.

Referring now to FIGS. 1-2A concurrently, the floor panel 100 also comprises a third flange 160 extending from a proximal edge 113 of the body 110 and a fourth flange 170 extending from a distal edge 114 of the body 110. The third flange 160 comprises a first surface 161 comprising a mechanical locking feature (in the form of a lateral groove 162). The fourth flange 170 comprises a top surface 171 comprising a mechanical locking feature (in the form of a protuberance 172). The third flange 160 is connected to and integrally formed with the first flange 120 so as to collectively form an L-shaped flange about the body 110 as illustrated. Similarly, the fourth flange 170 is connected to and integrally formed with the second flange 130 so as to collectively form an L-shaped flange about the body 110 as illustrated.

The third and fourth flanges 160, 170 are provided so that when a plurality of the floor panels 100 are arranged end-to-end (distal end to proximal end) to form a row of the floor panels 100 during installation (see FIGS. 9A-9C), the third and fourth flanges 160, 170 overlap and mechanically interlock with one another to prevent axial separation between the floor panels 100 in that row. In the exemplified embodiment, this is accomplished by the mechanical locking features 162, 172 mating with one another.

Figure 5:
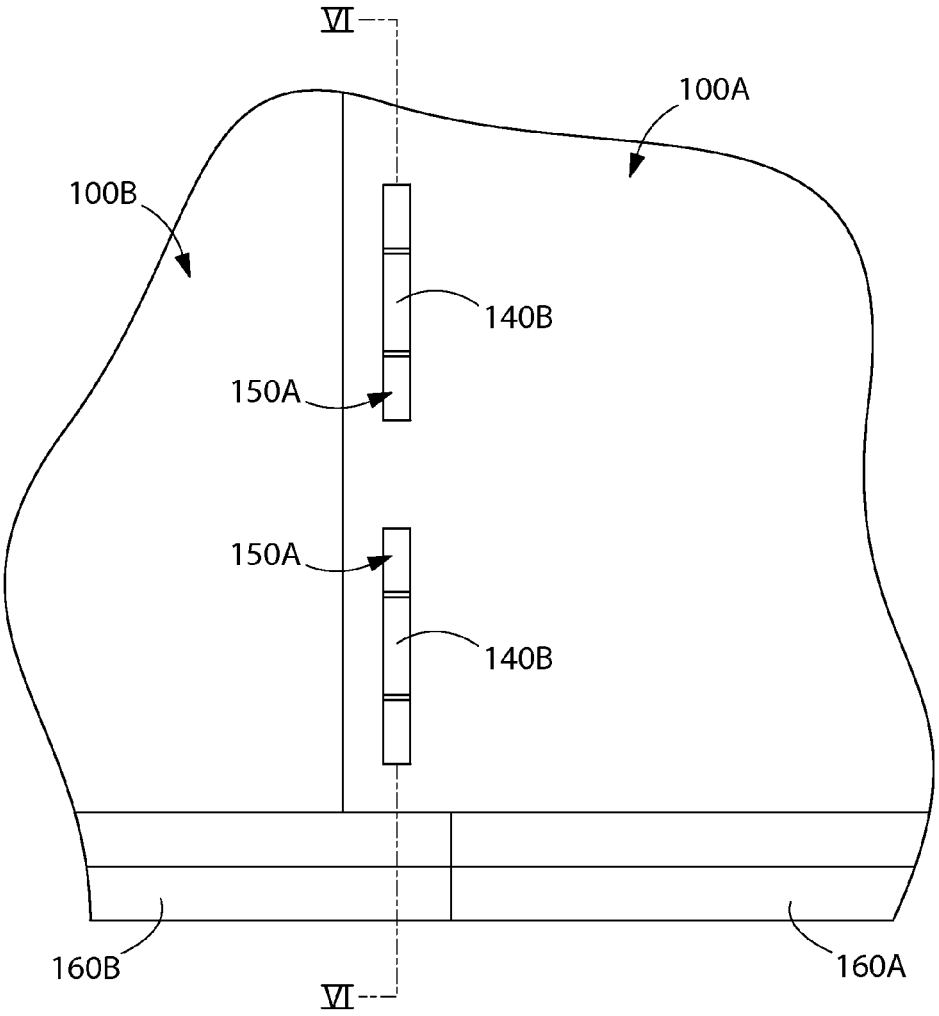
FIG. 5 is a bottom view of the proximal end portions of the mechanically interlocked floor panels of FIG. 4.
Figure 6:
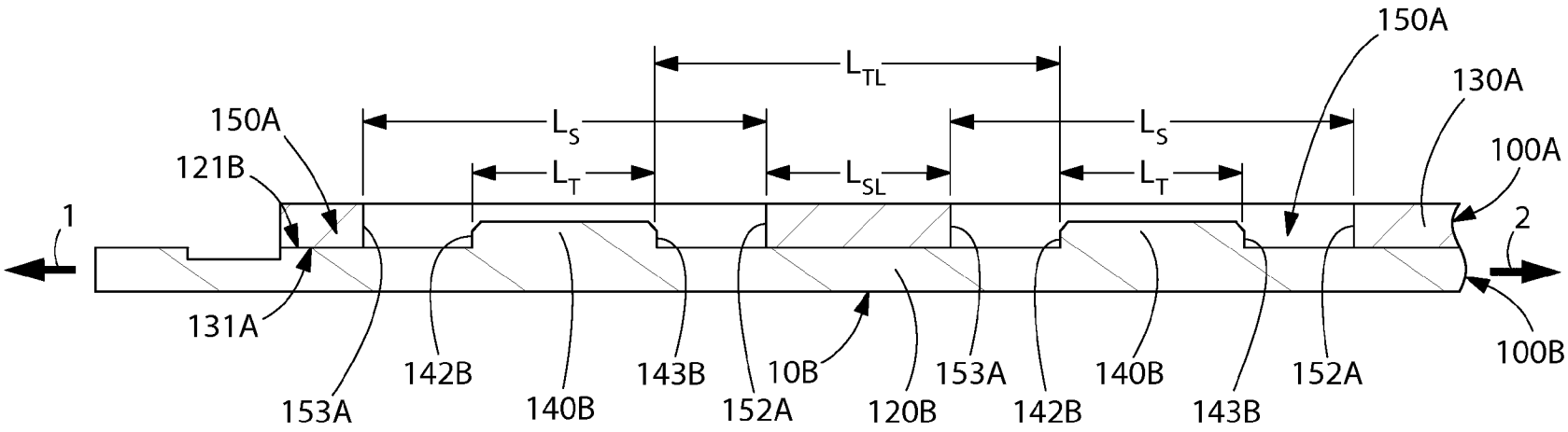
FIG. 6 is a cross-sectional view taken along view VI-VI of FIG. 5.

Referring now to FIGS. 4-6 concurrently, the mechanical interlocking between two laterally adjacent floor panels 100 will be discussed. For ease of reference and discussion, these floor panels 100 are numerically identified as a first floor panel 100A and a second floor panel 100B. The floor panels 100A, 100B are identical to the floor panel 100 discussed above (and identical to each other). Thus, like numbers will be used to refer to like elements with the addition of the suffix "A" for the first floor panel 100A and the suffix "B" for the second floor panel 100B.

As mentioned above, the teeth 140 and the slots 150 of the floor panel 100 are arranged in a corresponding pattern so that the first and second floor panels 100A, 100B can be mechanically interlocked together by inserting the teeth 140A of the first floor panel 100A into the slots 150B of the second floor panel 100B. When so interlocked, the top surfaces 10A, 10B of the first and second floor panels 100A, 100B are substantially flush (i.e., coplanar) with one another while the bottom surface 11A, 11B of the first and second floor panels 100A, 100B are also substantially flush (i.e., coplanar) with one another. Moreover, as discussed in greater detail below, due to the slots 150B being designed to have a slot length $L_S$ that is greater than the tooth length $L_T$ of the teeth 40A, the first and second panels 100A, 100B can slide relative to one another in a direction parallel to the longitudinal axes A-A a distance equal to $L_S$–$L_T$. However, at the same time, the mechanical interference/interaction between the teeth 140B and the slots 150A prevent the first and second panels 100A, 100B from being translated relative to one another in the transverse direction (i.e., a direction orthogonal to the longitudinal axes A-A and substantially parallel to the top surfaces 10A, 10B) without the teeth 140B first coming out of the slots 150A. Additionally, in certain embodiments of the invention (as will be discussed below with respect to FIG. 10), when the first and second floor panels 100A, 100B are interlocked as discussed above, the first and second floor panels 100A, 100B are also prohibited from being translated relative to one another in the vertical direction (i.e., a direction orthogonal to the longitudinal axes A-A and substantially orthogonal to the top surfaces 10A, 10B) without some degree of rotation and/or failure of components. Thus, in one embodiment of the invention, when the first and second floor panels 100A, 100B are mechanically interlocked as discussed above, the first floor panel 100A can slide relative to the second floor panel 100B in a direction substantially parallel to the longitudinal axes A-A a distance equal to Ls–$L_T$ while the first and second floor panels 100A, 100B remain mechanically interlocked and are prohibited translating relative to one another in the both the transverse and vertical directions. As will be described in greater detail below with respect to FIGS. 9A-9C, the ability of the first and second panels 100A-100B to slide relative to one another in a direction substantially parallel to the longitudinal axes A-A a distance equal to Ls–$L_T$ while mechanically interlocked results in a floating floor system 1000 that is easy and fast to install (due to the need for precision cuts being minimized and/or eliminated).

Referring now to FIGS. 6 and 7A-B concurrently, the relative slidability of the mechanically interlocked floor panels 100A, 100B will be described in greater detail. As described above, each of the teeth 140B extends from a first end wall 142B to a second end wall 143B while each of the slots 150A extends from a first slot wall 152A to a second slot wall 153A. When the first and second floor panels 100A, 1001 are mechanically interlocked such that each of the teeth 140B are nesting within the slots 150A (as shown in FIG. 6), the second floor panel 100B can be slid relative to first floor panel 100A in a first direction (indicated by arrow 1) that is substantially parallel to the longitudinal axes A-A until the first end walls 142B of the teeth 140B come into contact with and abut the second slot walls 153A of the slots 150A (as shown in FIG. 7A). Furthermore, when the first and second floor panels 100A, 100B are mechanically interlocked such that each of the teeth 140B are nesting within the slots 150A (as shown in FIG. 6), the second floor panel 100B can also be slid relative to first floor panel 100A in a second direction (indicated by arrow 2) that is substantially parallel to the longitudinal axes A-A until the second end walls 143B of the teeth 140B come into contact with and abut the first slot walls 151A of the slots 150A (as shown in FIG. 7B). The total distance available for relative sliding can be calculated by Ls–$L_T$.

For purposes of this application, achieving cuts in the field during installation with an accuracy of less than 6 mm is considered a precision cut. Thus, when the difference between $Ls-L_T$ is considered as an empirical measurement, $Ls-L_T$ is greater than or equal to 6 mm in one embodiment. In another embodiment, $Ls-L_T$ is greater than or equal to 9 mm. In yet another embodiment, $Ls-L_T$ is in a range of 6 mm to 13 mm.

However, the desired difference between $Ls-L_T$ may also be considered as a ratio between Ls and $L_T$ in certain embodiment of the invention. In one such embodiment, $L_S-L_T \geq 0.5\ L_T$. In another such embodiment, $L_S-L_T \geq L_T$. In yet another such embodiment, $2\ L_T \geq L_S-L_T \geq L_T$.

In another empirical embodiment, $L_T$ may be selected to be in a range of 4 mm to 12 mm while $L_S$ may be selected to be in a range 10 mm to 19 mm. In such an embodiment, the slot landing length $L_{SL}$ may be selected to be in a range of 6 mm to 10 mm. In a further empirical embodiment, $L_T$ may be selected to be in a range of 6 mm to 10 mm while L may be selected to be in a range 15 mm to 19 mm. In such an embodiment, the slot landing length $L_{SL}$ may be selected to be in a range of 6 mm to 10 mm.

In one specific embodiment, $L_T$ may be selected to be in a range of 7 mm to 9 mm, $L_s$ may be selected to be in a range 17 mm to 18 mm, $L_{SL}$ may be selected to be in a range of 7 mm to 8 mm and $L_{TL}$ may be selected to be in a range of 24 mm to 26 mm.

As can be seen in FIG. 6, the teeth 140B have a height that is less than the depth of the slots 150A. This allows the first surfaces 121B. 131A of the first and second flanges 120B, 130A to lie in surface contact with one another without the teeth 140B protruding beyond a plane formed by the second surface 132A of the second flange 130A.

Referring now to FIGS. 1, 2 and 3 concurrently, while it is desirable for ease of installation to afford a large relative motion ($Ls-L_T$) between the floor panels 100 when they are interlocked, in one aspect of the invention, this ease of installation is balanced by ensuring that the mechanically interlocked floor panels 100 exhibit sufficient horizontal locking strength (HLS). It should be noted that the term "horizontal," as used herein, refers to a plane that is substantially parallel to the top surfaces 10A, 10B of the floor panels 100A, 100B, which may or may not be parallel to the horizon. Thus, in these embodiments, the mechanical interlock system (comprising the slots 150 and the teeth 140) described above for the floor panel 100 is optimized, for example, by selecting the appropriate number and dimensions for the teeth 140, the slots 150, the slot landing area 151, and the tooth landing area 147.

For example, the HLS can be increased by: (1) making the slots 150 shorter in length; (2) increasing the length of the teeth 140; and (3) by shortening the length of the tooth landing area 147. The present invention optimizes the tradeoff between HLS and ease of installation by achieving an $Ls-L_T$ that is sufficient to eliminate precision cuts (cuts requiring accuracy of less than 6 mm) while at the same time ensuring that the floor panels 100 (when mechanically interlocked) exhibit an HLS that is above a predetermined lower threshold.

Referring now to FIGS. 1, 2, 3 and 4 concurrently, it can be seen that the floor panel 100 comprises X number of teeth 140, X number of slots 150, and a panel length of $L_P$. Each of the teeth 140 have a tooth length $L_T$ while each of the slots 150 have a slot length $L_S$. As will be described in greater detail below, in accordance with the present invention X and $L_T$ are selected so that when two of the floor panels 100 are mechanically interlocked as described above (see FIG. 4), the teeth 140 exert a horizontal resistance force ($F_{HR}$) per unit length of the teeth 140 in response to a horizontal separation force ($F_{HS}$) being applied to the floor panels 100 before the floor panels 100 separate from one another (which typically occurs by the teeth 140 being pulled out of the slots 150). The horizontal resistance force $F_{HR}$ corresponds to an HLS per unit length of $L_P$ that is greater than or equal to a predetermined lower threshold value.

Based on the desired HLS, calculations on alternative tooth 140 and slot 150 geometry can be performed in accordance with the present invention. For example, it can be estimate how many teeth 140 there will be over a unit distance, and what is the total tooth length ($X \cdot L_T$). It is assumed that the total tooth length ($X \cdot L_T$) resists the entire load.

As a threshold matter, it should be noted that the HLS exhibited by floor panels 100 mechanically interlocked in accordance with the present invention is dependent on the horizontal separation rate to which the mechanically interlocked floor panels 100 are subjected. In accordance with the present invention, the HLS for mechanically interlocked floor panels 100 is determined using a procedure by which the floor panels 100A, 100B are mechanically interlocked as shown in FIG. 4. While maintaining the first and second floor panels 100A, 100B in the mechanically interlocked configuration, the second floor panel 100B is clamped in a stationary vice of the test equipment while the first floor panel 100A is clamped in a translatable vice of the test equipment. The translatable vice is then moved away from the stationary vice in the transverse direction (parallel to the top surfaces 10A, 10B and orthogonal to the longitudinal axes A-A) at a constant horizontal separation rate. The horizontal separation of the vices continues until the mechanical locking system fails (such as by the teeth 140B lifting out of the slots 150A or the teeth 140B or the material around the slots 150 breaking or shearing), thereby resulting in the first and second floor panels 100A, 100B decoupling. The horizontal separation force $F_{HS}$ being applied to the first and second floor panels 100A, 100B at the time of the decoupling is measured by the test equipment. As mentioned above, the horizontal separation force $F_{HS}$ required to decouple mechanically interlocked floor panels 100 using the test equipment and procedures discussed above is dependent on the empirical value of the horizontal separation rate selected. For example, the exact same mechanically interlocked floor panels 100 will exhibit different HLS at different rates of horizontal separation. Thus, the calculations and examples below are for a horizontal separation rate of 25 mm/min to 26 mm/min. With this in mind, we turn to the calculations and examples.

For a target HLS of 2.45 Newton per millimeter (N/mm) for floor panels 100 having an $L_P$ of 1219 mm, the floor panels 100 will have to withstand (i.e., without decoupling) a horizontal separation force ($F_{HS}$) of:

$$F_{HS}=1219\ \text{mm} \times 2.45\ \text{N/mm}=2986\ \text{N}$$

If X=97 teeth and $P_L$=1219 mm, and the teeth 140 have an $L_T$ of 4.57 mm, then the total tooth length ($X \cdot L_T$) of the floor panel 100 will be 443.29 mm. Being that $F_{HR}=F_{HS}/X \cdot L_T$, this corresponds to a horizontal resistance force ($F_{HR}$) of:

$$F_{HR}=2986/443.29=6.7\ \text{N/mm}$$

Assuming that this $F_{HR}$ corresponds to an HLS (also known as joint locking strength) of 2.45 N/mm, the HLS of different tooth and slot geometries can be determined.

For example, for a floor panel 100 having a PL=1219.2 mm, an $L_S$=18.37 mm, an $L_T$=4.57 mm, and $L_{SL}$=6.74, it can be calculated that such a floor panel 100 would exhibit an HLS of 1.21 N/mm. For this example, it can be seen that the afforded relative movement ($L_S$–$L_T$) is 13.8 mm, thereby exhibiting a very high degree of ease of installation. However, the HLS of 1.21 N/mm is too low for a floor.

This floor panel 100 can be optimized according to the present invention, based on changing one or more of X, $L_T$, $L_S$, and $L_{SL}$ In accordance with the present invention, the total tooth length ($X \cdot L_T$) is increased and $L_S$ is decreased just enough so that a sufficient relative movement is maintained (for example, equal to or greater than 6 mm) while at the same time achieving an HLS that is sufficient for use as a floor (for example, equal to or greater than 1.7 N/mm when the horizontal separation rate is in a range of 25 mm/min to 26 mm/min).

For example, using the above calculations method, when an $L_T$ of 8 mm is selected, an $L_S$ of 17.5 mm is selected, and a $L_{SL}$ of 8 mm is selected, the HLS is calculated to be about 2.1 N/mm while the afforded relative movement ($L_S$–$L_T$) is about 9.5 mm.

Figure 8:
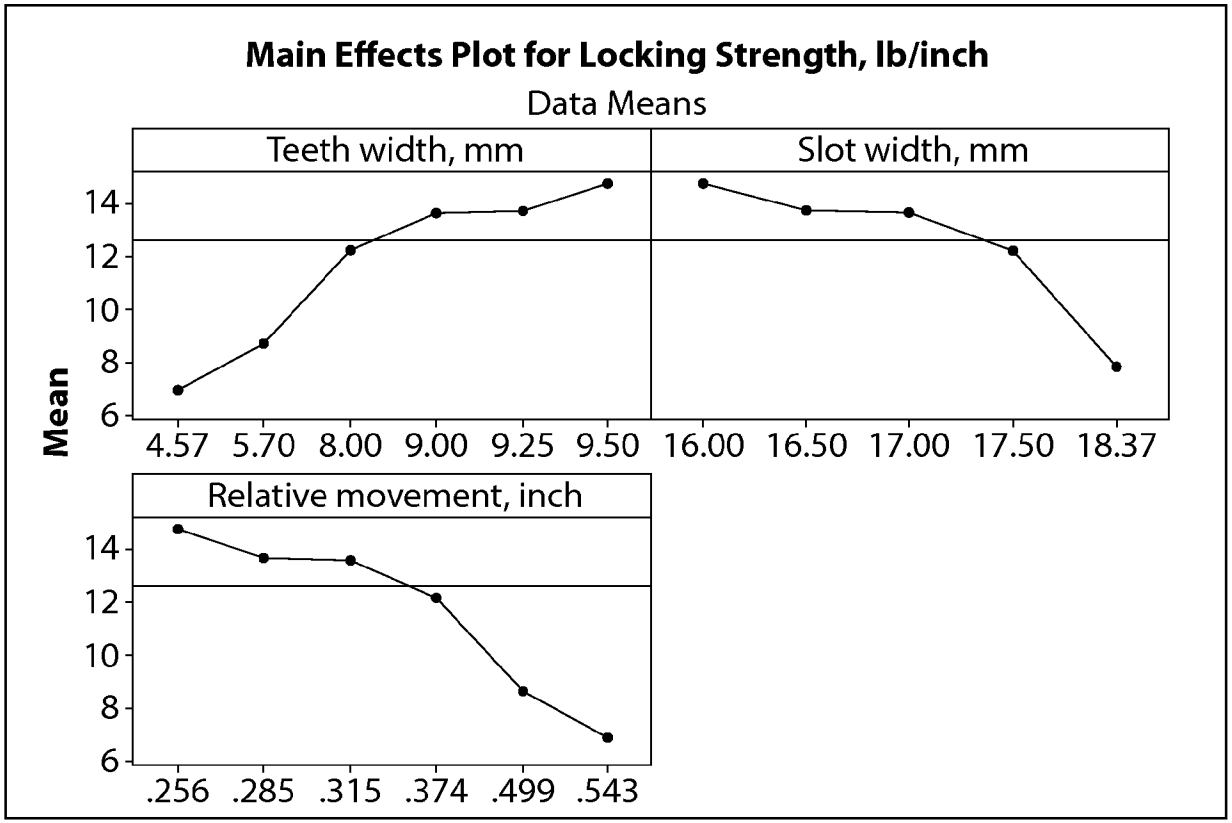
FIG. 8 includes three graphs plotting data for an exemplary floor panel in which the tooth length, the slot length, and the relative movement have been plotted against horizontal locking strength to optimize the horizontal locking strength against ease of installation.

Using the method and calculations described above, a plot of the HLS versus the ease of installation (i.e., $L_S$–$L_T$) was generated, and is currently set forth in FIG. 8. FIG. 8 illustrates one example of how $L_T$ and $L_S$ can be changed to generate a floor panel 100 having an optimized mechanical locking system that balances HLS and ease of installation through the afforded relative movement.

As is shown in FIG. 8, the teeth 140 geometry and spacing, as well as the slot 150 geometry and spacing, may be selected to yield an HLS approaching 2.3 N/mm (when using a horizontal separation rate between 25 mm/min to 26 mm/min), while the relative motion ($L_S$–$L_T$) between the planks has been reduced to around 9 mm. In such an example, according to FIG. 8, LT would be about 8.25 mm and LS would be about 17.5 mm.

As would be understood by one of skill in the art based on the present disclosure, the strength calculations are also controlled by the thickness of the floor panel, the number of layers associated with each floor panel, the material from which the floor panel is made, as well as other factors.

As mentioned above, a suitable level of ease of installation is achieved for a floating floor system 1000 that utilizes the floor panels 100 when $L_S$–$L_T$ is greater than or equal to 6 mm as the need for precision cutting is minimized and/or eliminated. Moreover, utilizing the above calculation methodology, it has been determined that X and $L_T$ should be selected so that when the floor panels 100 are interlocked as shown in FIG. 4, the teeth 140 exert an $F_{HR}$ per unit length of the teeth 140 in response to an $F_{HS}$ being applied to the floor panels (using the test procedure described above) before the floor panels 100 separate/decouple. $F_{HR}$ corresponds to an HLS per unit length of $L_P$ that is greater than or equal to a predetermined lower threshold value In one such embodiment, the lower threshold value is greater than or equal to 1.7 N/mm when the horizontal separation rate is in a range of 20 mm/min to 30 mm/min.

In another embodiment, X and $L_T$ are selected so that that the HLS per unit length of $L_P$ is within a predetermined range that is bounded by the lower threshold value and an upper threshold value. In one such embodiment, the predetermined lower threshold value is greater than equal to 1.7 N/mm and the upper threshold value is less than or equal to 3.5 N/mm when the horizontal separation rate is in a range of 20 mm/min to 30 mm/min. In another such embodiment, the lower threshold value is greater than or equal to 2.2 N/mm and the upper threshold value is greater than or equal to 2.6 N/mm when the horizontal separation rate is in a range of 25 mm/min to 26 mm/min In still other embodiments, X is selected such that $L_P$/X is in a range of 15 mm/tooth to 35 mm/tooth. In yet another embodiment, X is selected such that $L_P$/X is in a range of 20 mm/tooth to 30 mm/tooth. In a further embodiment, X is selected such that $L_P$/X is in a range of 23 mm/tooth to 35 mm/tooth.

Referring now to FIGS. 9A-9C, a method of installing a floating floor system 1000 using the floor panels 100 according to an embodiment of the present invention will be described. Beginning with FIG. 9A, a first row starter floor panel 100C is positioned atop a sub-floor 200 having its top surface 10 facing upward. The proximal end of the first row starter floor panel 100C is abutted against a vertical obstruction 201. The vertical obstruction can be a wall, a cabinet, a step or any other architectural feature that delimits the area of the sub-floor 200 that is to be covered.

Once the first row starter floor panel 1000 is in position, additional first row floor panels 100D, 100E are added to the first row in an end-to-end axial alignment. As discussed above, the third and fourth flanges 160, 170 of the first row floor panels 100C, 100D, 100E are used to axially interlock the first row floor panels 100C, 100D, 100E together. When one comes close to the opposing vertical obstruction 202 such that a whole floor panel will not fit in the first row, the floor panel 100F will be cut into two parts 100F' and 100F". The floor panel 100F' is installed as the last floor panel of the first row while the floor panel 100F" will be used to start the second row. Thus, the floor panel 100F" becomes the second row starter floor panel.

The second row starter floor panel 100F" is interlocked to the first row starter panel 100C in the manner described above for FIGS. 4-7. When initially interlocked to the first row starter panel 100C, a gap G exists between a proximal edge of the second row starter floor panel 100F" and the vertical obstruction 201. However, because the floor panels 100 have been optimized to balance ease of installation and HLS as discussed above, the second row starter floor panel 100F" can be slid toward the vertical obstruction 201 while remaining interlocked to the first row starter floor panel 100C to eliminate the gap G (see FIG. 9B). Thus, in this situation, $L_S$–$L_T$ is greater than or equal to the gap G. The second row is then completed as discussed above for the first row (see FIG. 9C) and the process is repeated until the entire sub-floor is covered.

Using the floating floor system 1000, it is possible after interlocking to move the floor panels 100 of adjacent rows in the longitudinal direction relative to one another the distance $L_S$–$L_T$. This enhancement makes it easier to cut the floor panels 100 without any great precision when starting a fresh row, such as near a wall or cabinet which, in turn, makes installation of the surface covering much easier and faster.

Referring now to FIG. 10, additional details of the floor panel 100 will be described. These details were omitted from the illustrations of FIGS. 1-9C in an attempt to avoid clutter and complexity of those figures. The floor panel 100 further comprises an undercut groove 75 located in the second lateral edge 112 of the body 110 adjacent the first surface 131 of the second lateral flange 130. This undercut grove 75 extends the entire $L_P$ in a continuous manner. Alternatively, it or can be segmented or extend only a portion of the $L_P$.

Additionally, the floor panel 100 also comprises a complimentary projection 85 that extends from a free lateral edge 125 of the first flange 120. The projection 85 has an upper surface 86 that is offset from the second surface 122 of the first flange 120. The projection 85 extends the entire $L_P$ in a continuous manner. Alternatively, it or can be segmented or extend only a portion of the $L_P$. When the floor panels 100 are interlocked as discusses above for FIGS. 4-7, the projection 85 is inserted into and nests within the undercut groove 75, thereby preventing vertical translation of floor panels 100 once they are so interlocked.

As can also be seen from FIG. 10, in the exemplified embodiment, the floor panel 100 is a laminate structure comprising a top layer 180 and a bottom layer 181. Each of the top layer 180 and the bottom layer 181 may comprises a plurality of layers. In one such embodiment, the top layer 180 may comprise a mix layer, a wear layer and a top coat layer. Moreover, in other embodiments, the floor panel 100 can comprise layers in addition to the top and bottom layers 180, 181, such as an intermediate fiberglass or polyester scrim layer. Additional layers may also include one or more of an antimicrobial layer, a sound deadening layer, a cushioning layer, a slide resistant layer, a stiffening layer, a channeling layer, a mechanically embossed texture, or a chemical texture.

The top layer 180 comprises the top surface of the body 110 and the second surface 122 of the first flange 120. In certain embodiments, the top surface of the body 110 and the second surface 122 collectively define the top surface 10 of the floor panel 100 and, thus, comprise a visible decorative pattern applied thereto. In one embodiment, the top layer 180 comprises a flexible sheet material comprising plastic, vinyl, polyvinyl chloride, polyester, or combinations thereof. The bottom layer 180, in certain embodiments, may comprise a flexible sheet material comprising plastic, vinyl, polyvinyl chloride, polyester, polyolefin, nylon, or combinations thereof.

In one embodiment, the body 110 of the floor panel 100 has thickness in the range of 2 mm to 12 mm. In another embodiment, the body 110 of the floor panel 100 has thickness in the range of 2 mm to 5 mm. In one specific embodiment, the body 110 of the floor panel 100 has thickness in the range of 3 mm to 4 mm.

The floor panel 100, in one embodiment, is designed so as to have a Young's modulus in a range of 240 MPA to 620 MPA. In another embodiment, the floor panel 100 is designed so as to have a Young's modulus in a range of 320 MPA to 540 MPA In the illustrated embodiment, the top layer 180 comprises a clear film/wear layer positioned atop a top mix layer. The top mix layer may be formed, for example, from a substantially flexible sheet material, such as plastic, vinyl, polyvinyl chloride, polyester, or combinations thereof. A visible decorative pattern is applied to the top surface of the top layer 180. The clear film/wear layer, in certain embodiments, may have a thickness of about 4-40 mils (about 0.1-1.0 millimeters), preferably about 6-20 mils (about 0.15-0.5 millimeters), and more preferably about 12-20 mils (about 0.3-0.5 millimeters).

The top layer 180, in certain embodiments, may have a thickness of about 34-110 mils (about 0.8-2.8 millimeters), preferably about 37-100 mils (about 0.9-2.5 millimeters), and more preferably about 38-100 mils (about 1.0-2.5 millimeters).

The bottom layer 181, in the illustrated embodiment, comprises only a bottom mix layer. The bottom mix layer may be formed, for example, from a flexible sheet of material comprising plastic, vinyl, polyvinyl chloride, polyester, polyolefin, nylon, or combinations thereof. The bottom layer 181 may also, in other embodiments, include recycle material, such as post-industrial or post-consumer scrap.

The bottom layer 181, in certain embodiments, may have a thickness of about 34-110 mils (about 0.8-2.8 millimeters), preferably about 37-100 mils (about 0.9-2.5 millimeters), and more preferably about 38-100 mils (about 1.0-2.5 millimeters).

The bottom surface of the top layer 180 is laminated to the top surface of the bottom layer 181 by an adhesive. The adhesive may be, for example, any suitable adhesive, such as a hot melt adhesive, a pressure sensitive adhesive, or a structural and/or reactive adhesive. The adhesive may have, for example, a bond strength of at least 25 force-pounds, and more preferably about 4.3 N/mm after having been heat aged for about 24 hours at 145 degrees Fahrenheit. In the illustrated embodiment, the adhesive is provided on substantially an entirety of the top surface of the bottom layer 12. The adhesive may be applied to have a thickness, for example, of about 1-2 mils (about 0.0254-0.0508 millimeters). It will be appreciated by those skilled in the art, however, that the thickness of the adhesive may vary depending on the texture of the bottom surface of the top layer 180 and the texture of the top surface of the bottom layer 181 in that a substantially smooth surface would require less of the adhesive due to better adhesion and bond strength.

In one embodiment, in order to minimize the risk of shearing and/or delamination between the top layer 180 and the bottom layer 181 due to the stresses imparted by the mechanical interlock system (i.e., the teeth 140 and the slots 150), at least a portion of the first flange 120 and a portion of the second flange 130 are formed by the same integrally formed layer (such as the top mix layer or the bottom mix layer). In the exemplified embodiment, the teeth 140, the lower portion of the first flange 120, and an upper portion of the second flange 130 that defines the slots 150 are all integrally formed by the top layer 180 (and more particularly the top mix layer).

The top and bottom mix layers are made from plasticizer, filler, and binder, and may be made in the following percentages for certain embodiments:

Average % Plasticizer of Bottom Mix layer and the Top Mix layer (without the clear film): Range of 6.4% to 8.1%

Average % Filler of Bottom Mix layer and the Top Mix layer (without the clear film): Range of 65.9% to 78.7%

Average % Binder of Bottom Mix layer and the Top Mix layer (without the clear film): Range of 21.3% to 34.1%

By altering the percentages, the wear, flexibility and other performance characteristics of the floor panel 100 can be varied.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A floating floor system comprising:

a plurality of panels, each of the panels having a panel length Lp measured along a longitudinal axis and comprising:

a body;

a first flange extending from a first lateral edge of the body;

a second flange extending from a second lateral edge of the body;

X number of spaced apart teeth protruding from a first surface of the first flange, each of the teeth extending a tooth length $L_T$;

a plurality of spaced apart slots formed in a first surface of the second flange, each of the slots extending a slot length $L_S$; and wherein $L_S-L_T$ is greater than or equal to 6 mm;

wherein X and $L_T$ are such that when first and second ones of the plurality of panels are interlocked so that the teeth of the first panel are located in the slots of the second panel, the teeth exert a horizontal resistance force $F_{HR}$ per unit length of the teeth in response to a horizontal separation force $F_{HS}$ applied to the first and second panels before the first and second panels separate, the horizontal resistance force $F_{HR}$ corresponding to a horizontal locking strength HLS per unit length of $L_P$ that is greater than or equal to a predetermined lower threshold value; and wherein the horizontal separation force $F_{HS}$ is applied by separating the interlocked first and second panels at a horizontal separation rate, wherein the lower threshold value is greater than or equal to 1.7 N/mm when the horizontal separation rate is in a range of 20 min/min to 30 min/min.

2. The floating floor system according to claim 1 wherein $Ls-L_T$ is in a range of 6 mm to 13 mm.

3. The floating floor system according to claim 1 wherein $L_P/X$ is in a range of 15 mm/tooth to 35 min/tooth.

4. The floating floor system according to claim 1, wherein adjacent ones of the slots are separated from one another by a slot landing length $L_{SL}$, and wherein $L_T$ is in a range of 4 mm to 12 mm, $L_s$ is in a range 10 mm to 19 mm, and $L_{SL}$ is in a range of 6 mm to 10 mm.

5. The floating floor system according to claim 1, wherein for each of the panels, the teeth are equi-spaced from one another along a tooth axis that is substantially parallel to the longitudinal axis and the slots are equi-spaced from one another along a slot axis that is substantially parallel to the longitudinal axis.

6. The floating floor system according, to claim 1, wherein the first surface of the first flange is substantially coplanar with the first surface of the second flange.

7. The floating floor system according to claim 1, wherein when the first and second ones of the panels are interlocked, the first panel can slide relative to the second panel in a direction substantially parallel to the longitudinal axes of the first and second panels a distance equal to $Ls-L_T$ while the first and second panels remain interlocked.

8. The floating floor system according to claim 1, wherein for each of the panels, the first flange comprises a second surface that is substantially coplanar with a top surface of the body and wherein the second flange comprises a second surface that is substantially coplanar with a bottom surface of the body.

9. The floating floor system according to claim 8 wherein for each of the panels, the panel is a laminate structure comprising a top layer and a bottom layer, the top layer comprising the top surface of the body and the second surface of the first flange, and wherein the top surface of the body and the second surface of the first flange comprises a visible decorative pattern.

10. The floating floor system according to claim 8 wherein the top layer and/or bottom layer comprise a flexible sheet material comprising plastic, vinyl, polyvinyl chloride, polyester, or combinations thereof.

11. The floating floor system according to claim 9 wherein the top layer comprises a mix layer, a wear layer and a top coat layer.

12. The floating floor system according to claim 1, wherein for each of the panels, the teeth and a lower portion of the first flange are formed by the top layer, and wherein an upper portion of the second flange is formed by the top layer.

13. The floating floor system according to claim 1, wherein for each of the panels, the panel has a Young's modulus in a range of 240 MPA to 620 MPA.

14. The floating floor system according to claim 1, wherein for each of the panels:

the first flange comprises a second surface that is substantially coplanar with a top surface of the body;

the second flange comprises a second surface that is substantially coplanar with a bottom surface of the body;

an undercut groove is located in the second lateral edge of the body adjacent the first surface of the second lateral flange;

a projection extends from a free lateral edge of the first flange, the projection having an upper surface that is offset from the second surface of the first flange; and wherein when the first and second panels are interlocked, the projection nests within the undercut groove to prevent vertical separation of the first and second panels.

15. A floating floor system comprising:

a plurality of panels, each of the panels having a panel length $L_P$ measured along a longitudinal axis and comprising:

a body;

a first flange extending from a first lateral edge of the body;

a second flange extending from a second lateral edge of the body;

X number of spaced apart teeth protruding from a first surface of the first flange, each of the teeth extending a tooth length $L_T$;

a plurality of spaced apart slots formed in a first surface of the second flange, each of the slots extending a slot length $L_S$; and wherein $L_S-L_T$ is greater than or equal to 6 mm;

wherein X and $L_T$ are such that when first and second ones of the plurality of panels are interlocked so that the teeth of the first panel are located in the slots of the second panel, the teeth exert a horizontal resistance force $F_{HR}$ per unit length of the teeth in response to a horizontal separation force $F_{HS}$ applied to the first and second panels before the first and second panels separate, the horizontal resistance force $F_{HR}$ corresponding to a horizontal locking strength HLS per unit length of $L_P$ that is greater than or equal to a predetermined lower threshold value;

wherein X and $L_T$ are such that when first and second ones of the plurality of panels are interlocked so that the teeth of the first panel are located in the slots of the second panel, the teeth exert the horizontal resistance force $F_{HR}$ per unit length of the teeth in response to the horizontal separation force $F_{HS}$ applied to the first and second panels before the first and second panels separate, the horizontal resistance force $F_{HR}$ corresponding to the horizontal locking strength HLS per unit length of $L_P$ being in a predetermined range, the predetermined range bounded by the lower threshold value and an upper threshold value;

wherein the horizontal separation force $F_{HS}$ is applied by separating the interlocked first and second panels at a horizontal separation rate; and wherein the predetermined lower threshold value is 13 N/mm and the upper threshold value is less than or equal to 15 N/mm when the horizontal separation rate is in a range of 20 mm/min to 30 mm/min.

16. A method of installing a plurality of floor panels to create a floating floor system, each of the floor panels comprising a body having a longitudinal axis, an upper flange extending from a first lateral edge of the body, a lower flange extending from a second lateral edge of the body, a plurality of spaced apart teeth protruding from a lower surface of the upper flange, each of the teeth extending a tooth length $L_T$, a plurality of spaced apart slots formed in an upper surface of the lower flange, each of the slots extending a slot length $L_S$, the method comprising:

a) coupling a plurality of first row floor panels together in an end-to-end axial alignment to form a first row of floor panels, wherein a first row starter floor panel is in abutment with a vertical obstruction;

b) interlocking a second row starter floor panel of a second row of the floor panels to one or more of the first row floor panels by overlapping the lower flanges of the one or more first row floor panels with the upper flange of the second row starter floor panel so that the teeth of the second row starter floor panel are located within the slots of one or more first row floor panels, wherein the one or more first row floor panels comprises the first row starter floor panel and a gap exists between a proximal edge of the second row starter floor panel and the vertical obstruction; and c) sliding the second row starter floor panel toward the vertical obstruction to eliminate the gap while the second row starter floor panel remains interlocked to the one or more first row floor panels.

17. The method of claim 16 wherein the second row starter floor panel is capable of sliding a distance $Ls-L_T$, and wherein when the second row starter floor panel is interlocked to the one or more first row floor panels, a horizontal locking strength HLS per unit length of the second row starter panel that is greater than 1.7 N/mm is achieved between the one or more first row floor panels and the second row starter floor panel.

* * * * *